US011536282B2

(12) United States Patent
Tsai

(10) Patent No.: US 11,536,282 B2
(45) Date of Patent: Dec. 27, 2022

(54) BUILT-IN ELECTRIC AIR PUMP FOR INFLATABLE PRODUCT

(71) Applicant: ZHEJIANG HONGZHU PLASTIC & HARDWARE CO., LTD., Zhejiang (CN)

(72) Inventor: Wei-Ting Tsai, Jiashan (CN)

(73) Assignee: ZHEJIANG HONGZHU PLASTIC & HARDWARE CO., LTD., Zhejiang (CN)

( * ) Notice: Subject to any disclaimer, the term of this patent is extended or adjusted under 35 U.S.C. 154(b) by 0 days.

(21) Appl. No.: 17/170,907

(22) Filed: Feb. 9, 2021

(65) Prior Publication Data

US 2022/0252075 A1 Aug. 11, 2022

(51) Int. Cl.

| | |
|---|---|
| ***F04D 25/06*** | (2006.01) |
| ***F04D 29/42*** | (2006.01) |
| ***F04D 29/60*** | (2006.01) |
| ***F04D 17/10*** | (2006.01) |

(52) U.S. Cl.

CPC ..... *F04D 25/06* (2013.01); *F04D 17/10* (2013.01); *F04D 25/0693* (2013.01); *F04D 29/4206* (2013.01); *F04D 29/601* (2013.01); *F04D 25/0673* (2013.01)

(58) Field of Classification Search

None

See application file for complete search history.

(56) References Cited

U.S. PATENT DOCUMENTS

| | | | | |
|---|---|---|---|---|
| 5,189,327 | A * | 2/1993 | Ootsuka | F04D 25/08 310/71 |
| 6,176,689 | B1 * | 1/2001 | Bumbel | F04D 29/661 417/312 |
| 7,210,902 | B2 * | 5/2007 | Song | F04D 29/4213 415/206 |
| 8,641,391 | B2 * | 2/2014 | Pan | F04D 29/503 417/315 |
| 10,508,651 | B2 * | 12/2019 | Liu | F04D 25/084 |
| 2005/0084400 | A1 * | 4/2005 | Tsai | F04D 29/626 417/423.14 |
| 2019/0387897 | A1 * | 12/2019 | Jiang | F04D 29/503 |

* cited by examiner

*Primary Examiner* — Nathan C Zollinger
*Assistant Examiner* — Timothy P Solak
(74) *Attorney, Agent, or Firm* — Leong C. Lei

(57) ABSTRACT

A built-in electric air pump for an inflatable product includes an outer casing, an inner casing, a motor, and an impeller. The outer casing has an accommodating cavity therein. The inner casing is rotatably disposed in the accommodating cavity. By rotating the inner casing, the inflatable product can be inflated or deflated.

8 Claims, 4 Drawing Sheets

BUILT-IN ELECTRIC AIR PUMP FOR INFLATABLE PRODUCT

BACKGROUND OF THE INVENTION

1. Field of the Invention

The present invention relates to an air pump, and more particularly to a built-in electric air pump for an inflatable product.

2. Description of the Prior Art

In our daily life, air pumps for inflation and deflation are widely used. For example, when packaging bags need to be compressed, a suction pump is used to exhaust the air in the packaging bags. When an inflatable cushion is to be used, an air pump is required to inflate the inflatable cushion.

For large-sized inflatable products, the inflatable space is quite large. In order to provide a rapid deflation function, the inflatable products generally have an inflation port and an exhaust port. When the inflatable product is to be inflated, the nozzle of the air pump is connected to the inflation port of the inflatable product. Then, the air pump is started to pump air into the inflatable space of the inflatable product through the inflation port. When the inflatable product is to be deflated, the nozzle of the air pump is connected to the exhaust port of the inflatable product, and then the air pump is started to pump air out of the inflatable space. For the user, when the inflatable product is to be inflated or deflated every time, it is necessary to correctly select the inflation port or exhaust port for inflation or deflation. The structure of switching the working state is complicated. Therefore, it is necessary to study a solution to solve the above-mentioned problems.

SUMMARY OF THE INVENTION

In view of the shortcomings of the prior art, the primary object of the present invention is to provide a built-in electric air pump for an inflatable product, which can effectively solve the problems of single function or complicated structure in switching working conditions and inconvenience of production in the conventional air pump.

In order to achieve the above object, the present invention adopts the following technical solutions:

A built-in electric air pump comprises an outer casing, an inner casing, a motor, and an impeller. The outer casing has an accommodating cavity therein. The outer casing has a first air opening communicating with the accommodating cavity and its exterior. The outer casing is formed with a second air opening communicating with the accommodating cavity and an inflatable product. The second air opening is provided with a tongue configured to close the second air opening or to open the second air opening by swinging into the inflatable product. The inner casing is rotatably disposed in the accommodating cavity. An outer wall of the inner casing is provided with a protruding portion for pushing the tongue to swing into the inflatable product so as to open the second air opening. The inner casing includes a left casing and a right casing. The left casing and the right casing are assembled and fixed by ultrasonic welding or screws. The left casing and the right casing encircle a mounting cavity and an air cavity. The mounting cavity communicates with the air cavity. The inner casing is formed with a third air opening communicating with the air cavity and the first air opening. The inner casing is formed with a fourth air opening communicating with the air cavity and the second air opening. The motor is clamped and fixed between the left casing and the right casing. The motor is located in the mounting cavity. The impeller is mounted onto an output shaft of the motor and driven to rotate by the motor. The impeller is located in the air cavity.

Compared with the prior art, the present invention has obvious advantages and beneficial effects. Specifically, it can be known from the above technical solutions:

The inner casing is rotatably installed in the outer casing. The protruding portion of the inner casing along with the rotation of the inner casing controls the tongue to open or close the second air opening, so as to inflate or deflate an inflatable product. The built-in electric air pump has a simple structure and does not need to be additionally provided with a button to switch the inflation and deflation functions, which simplifies the assembly procedure in the manufacturing process and facilitates production.

DETAILED DESCRIPTION OF THE PREFERRED EMBODIMENTS

Embodiments of the present invention will now be described, by way of example only, with reference to the accompanying drawings.

Figure 1:
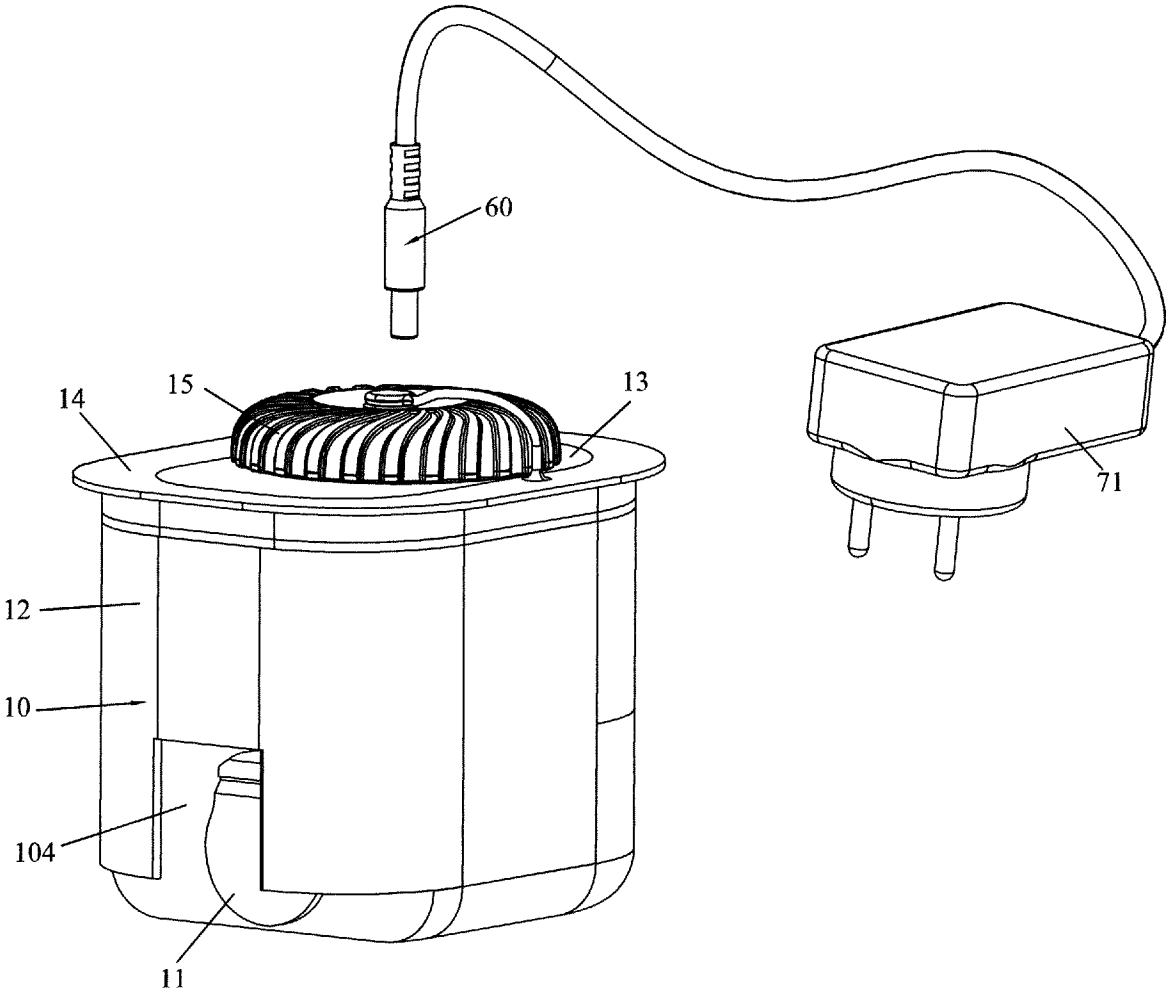
FIG. 1 is a perspective view in accordance with a preferred embodiment of the present invention.
Figure 2:
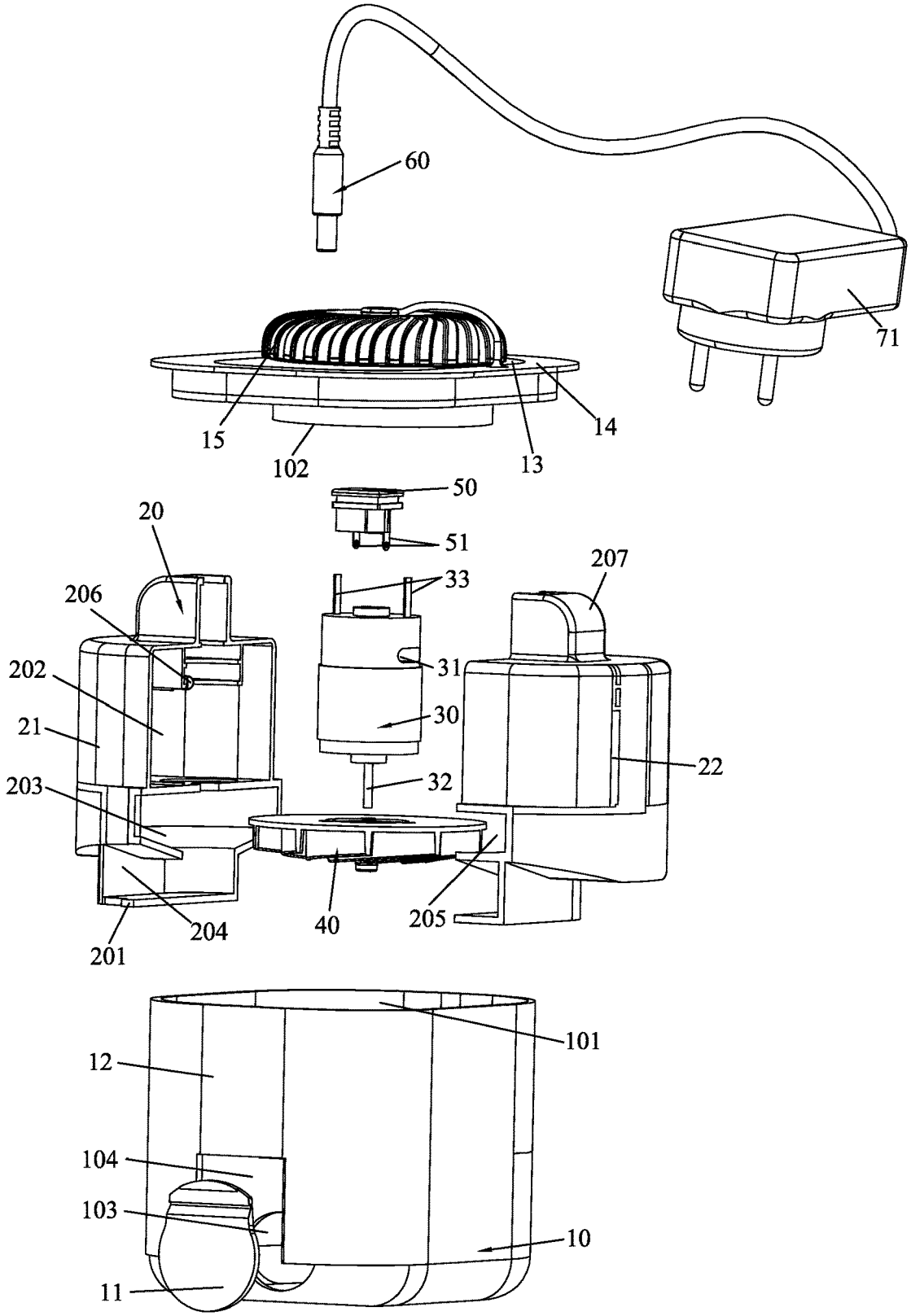
FIG. 2 is an exploded view in accordance with the preferred embodiment of the present invention.
Figure 3:
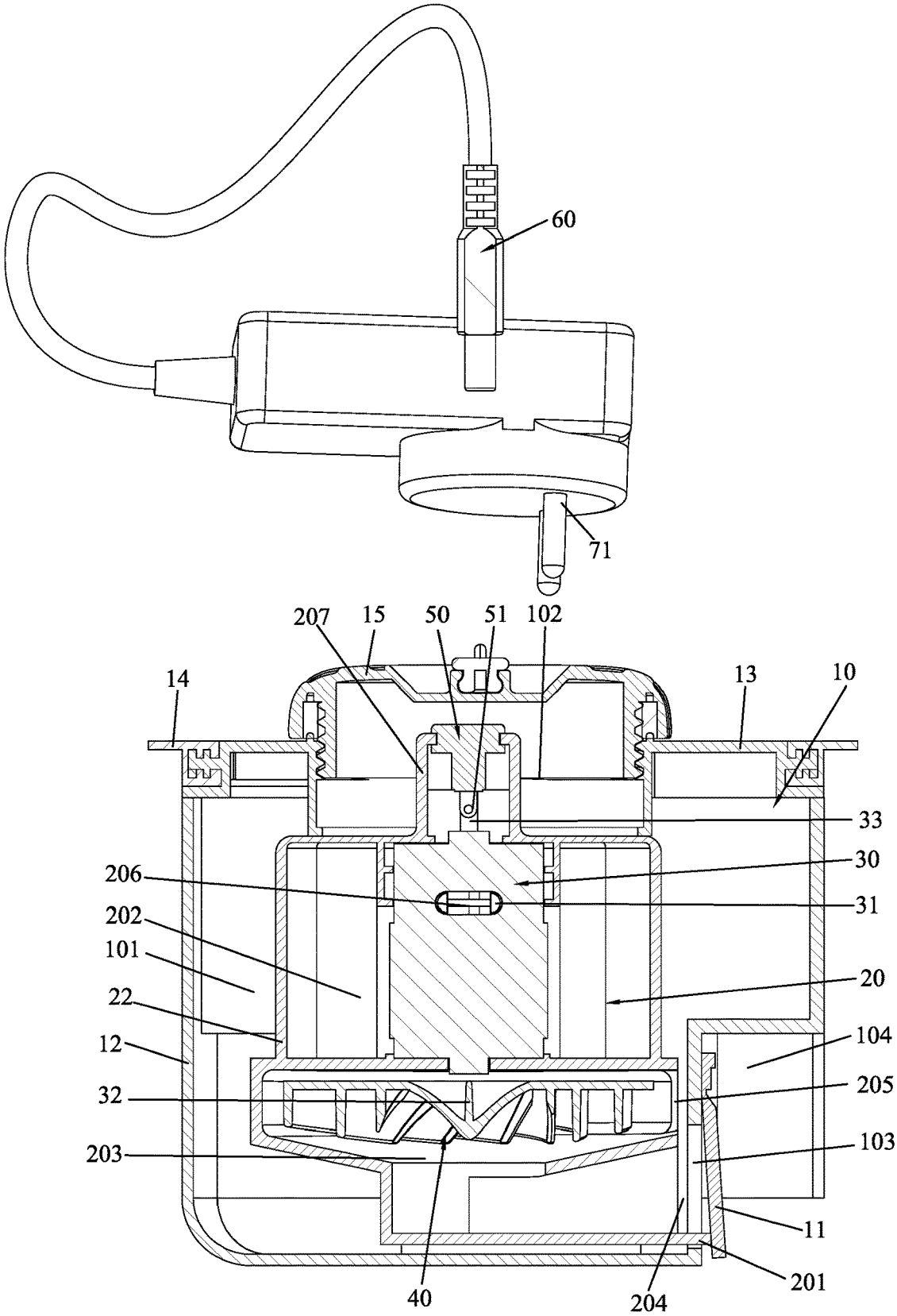
FIG. 3 is a cross-sectional view in accordance with the preferred embodiment of the present invention.
Figure 4:
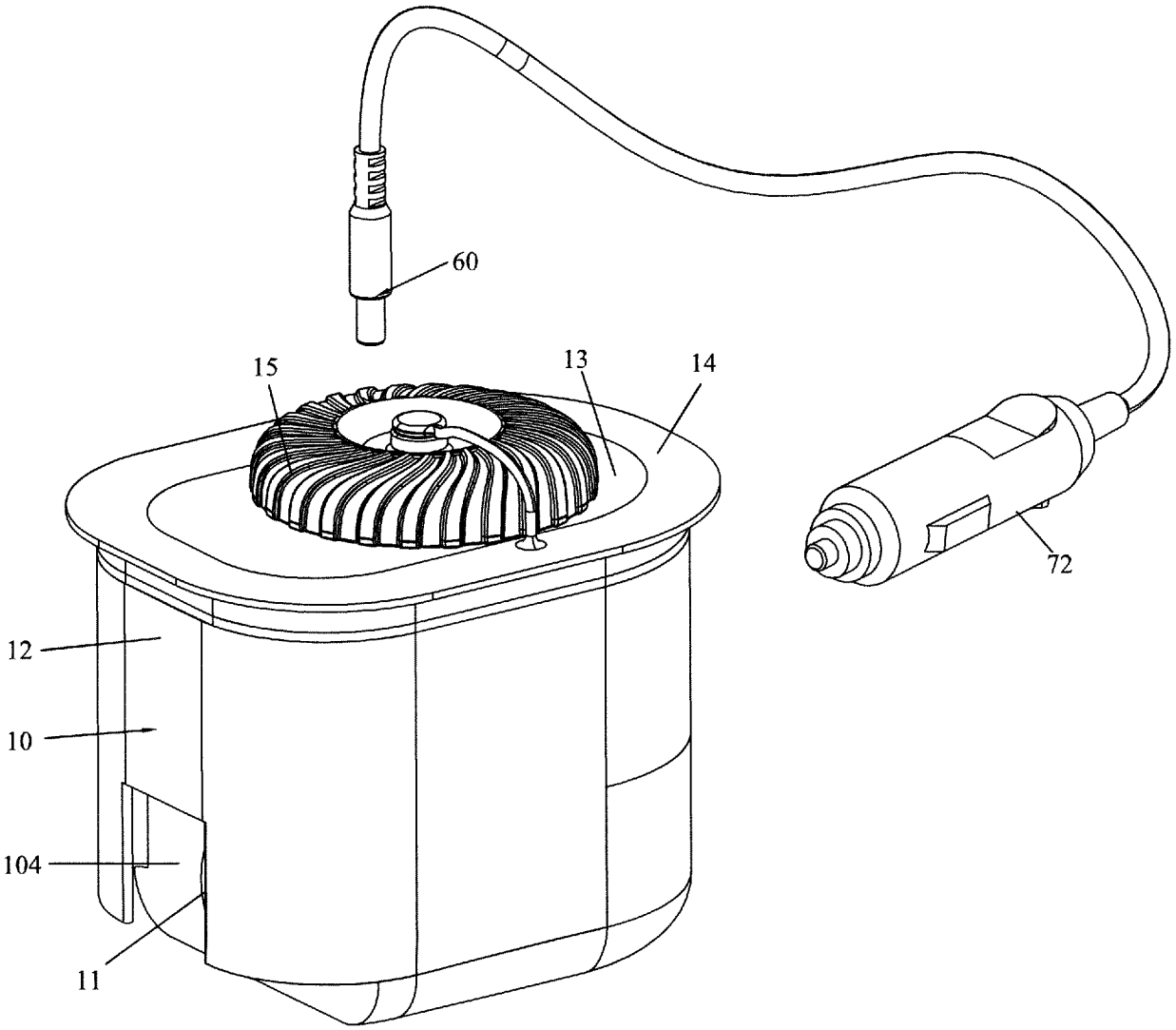
FIG. 4 is a perspective view showing another DC plug in the present invention.

Please refer to FIGS. 1 to 4, which show the specific structure of the preferred embodiment of the present invention, comprising an outer casing 10, an inner casing 20, a motor 30, and an impeller 40.

The outer casing 10 has an accommodating cavity 101 therein. The outer casing 10 has a first air opening 102 communicating with the accommodating cavity 101 and its exterior. The outer casing 10 is formed with a second air opening 103 communicating with the accommodating cavity 101 and an inflatable product. The second air opening 103 is provided with a tongue 11 configured to close the second air opening 103 or to open the second air opening 103 by swinging into the inflatable product. In this embodiment, the outer casing 10 includes a bottom casing 12 and a panel 13. The panel 13 is arranged on the top of the bottom casing 12 to surround the accommodating cavity 101. The first air opening 102 is located on the panel 13. The second air opening 103 is located on the bottom casing 12. A covering 14 is sleeved on the panel 13. A sealing cover 15 is connected to the covering 14. The sealing cover 15 is detachably mounted to the first air opening 102 and configured to hermetically cover the first air opening 102. A recess 104 is formed on one side of the lower end of the outer casing 10. The second air opening 103 is located on the bottom of the recess 104. The tongue 11 is swingably mounted in the recess 104. The outer casing 10 is made of a plastic material.

The inner casing 20 is rotatably disposed in the accommodating cavity 101. The outer wall of the inner casing 20 is provided with a protruding portion 201 for pushing the tongue 11 to swing into the inflatable product so as to open the second air opening 103. The inner casing 20 includes a left casing 21 and a right casing 22. The left casing 21 and the right casing 22 are assembled and fixed by ultrasonic welding or screws. The left casing 21 and the right casing 22 encircle a mounting cavity 202 and an air cavity 203. The mounting cavity 202 communicates with the air cavity 203. The inner casing 20 is formed with a third air opening 204 communicating with the air cavity 203 and the first air opening 102. The inner casing 20 is formed with a fourth air opening 205 communicating with the air cavity 203 and the second air opening 103. In this embodiment, the inner casing 20 is made of a plastic material. The left casing 21 and the right casing 22 have retaining posts 206 extending from the inner walls of the left casing 21 and the right casing 22. The top of the inner casing 20 has a rotation control portion 207. The rotation control portion 207 is located in the first air opening 102.

The motor 30 is clamped and fixed between the left casing 21 and the right casing 22. The motor 30 is located in the mounting cavity 202. In this embodiment, the peripheral side of the motor 30 has a heat dissipation hole 31. The retaining posts 206 are inserted and secured into the heat dissipation hole 31.

The impeller 40 is mounted onto an output shaft 32 of the motor 30 and is driven to rotate by the motor 30. The impeller 40 is located in the air cavity 203. In this embodiment, the fourth air opening 205 is located adjacent to the periphery of the impeller 40.

A DC socket 50 is provided on the inner casing 20. The DC socket 50 is clamped and fixed between the left casing 21 and the right casing 22. A DC plug 60 is connected to the DC socket 50. A first soldering lug 51 of one terminal of the DC socket 50 is welded to a second soldering lug 33 of one terminal of the motor 30. A first soldering lug 51 of another terminal of the DC socket 50 is welded to a second soldering lug 33 of another terminal of the motor 30. The DC plug 60 may be connected to an adapter 71 or a car cigarette lighter plug 72.

The assembly process and working principle of this embodiment are described in detail as follows:

For assembly, the impeller 40 is first mounted onto the output shaft 32 of the motor 30 and is driven by the motor 30. Then, the first soldering lug 51 of one terminal of the DC socket 50 is welded to the second soldering lug 33 of one terminal of the motor 30. The first soldering lug 51 of another terminal of the DC socket 50 is welded to the second soldering lug 33 of another terminal of the motor 30. After that, the left casing 21 and the right casing 22 are combined to form the inner casing 20. At this time, the motor 30 is located in the mounting cavity 202 of the inner casing 20, and the impeller 40 is located in the air cavity 203 of the inner casing 20. After the inner casing 20 is placed in a suitable position in the accommodating cavity 101 of the outer casing 10, the first air opening 102 of the outer casing 10 and the panel 13 are connected and fixed by ultrasonic welding or screws. Finally, the tongue 11 is arranged at the second air opening 103. The tongue 11 swings into the inflatable product to open the second air opening 103 or close the second air opening 103.

When in use, this product is built in an inflatable product (such as an air mattress, etc.) to form a whole with the inflatable product. This product has two working states, namely, an inflation state and a deflation state.

In the inflation state, first, the sealing cover 15 is unscrewed. The rotation control portion 207 of the inner casing 20 is rotated for the inner casing 20 to be rotated to a position where the second air opening 103 faces the air cavity 203 and the fourth air opening 205. At this time, in a natural state, the tongue 11 is in a state of closing the second air opening 103. Next, the DC socket 50 and the DC plug 60 are connected and the power is turned on. The motor 30 starts to work. External air flows into the mounting cavity 202 and the air cavity 203 and is pressurized by the impeller 40. The pressurized air pushes the tongue 11 to open the second air opening 103, so that the air flows into the inflatable product. When the inflatable product is full of air, the power is turned off and the motor 30 stops working. The air pressure inside the inflatable product causes the tongue 11 to swing in the opposite direction to close the second air opening 103, so that the air inside the inflatable product is not easy to leak.

In the deflation state, first, by rotating the inner casing 20, the rotation control portion 207 of the inner casing 20 is rotated to push the protruding portion 201 of the inner casing 20 to push away the tongue 11. At this time, under the action of the protruding portion 201, the tongue 11 is pushed toward the inflatable product to open the second air opening 103. The air in the inflatable product flows into the air cavity 203 and the mounting cavity 202 through the second air opening 103, and then is exhausted from the first air opening 102 to the outside. At the same time, the motor 30 can be started to turn reversely to speed up the exhaust of the air in the inflatable product.

What is claimed is:

1. A built-in electric air pump, comprising an outer casing, an inner casing, a motor, and an impeller; the outer casing having an accommodating cavity therein, the outer casing having a first air opening communicating with the accommodating cavity and an exterior, the outer casing being formed with a second air opening communicating with the accommodating cavity, the second air opening being provided with a tongue configured to close the second air opening or to open the second air opening; the inner casing being rotatably disposed in the accommodating cavity, an outer wall of the inner casing being provided with a protruding portion for pushing the tongue so as to open the second air opening, the inner casing including a left casing and a right casing, the left casing and the right casing being assembled and fixed by ultrasonic welding or screws, the left casing and the right casing encircling a mounting cavity and an air cavity, the mounting cavity communicating with the air cavity, the inner casing being formed with a third air opening communicating with the air cavity and the first air opening, the inner casing being formed with a fourth air opening communicating with the air cavity and the second air opening; the motor being clamped and fixed between the left casing and the right casing, the motor being located in the mounting cavity; the impeller being mounted onto an output shaft of the motor and driven to rotate by the motor, the impeller being located in the air cavity, wherein the outer casing includes a bottom casing and a panel, the panel is arranged on a top of the bottom casing to surround the accommodating cavity, the first air opening is located on the panel, the second air opening is located on the bottom casing, a covering is sleeved on the panel, a sealing cover is connected to the covering, the sealing cover is detachably mounted to the first air opening and configured to hermetically cover the first air opening.

2. The built-in electric air pump as claimed in claim 1, wherein a recess is formed on one side of a lower end of the outer casing, the second air opening is located on a bottom of the recess, and the tongue is swingably mounted in the recess.

3. The built-in electric air pump as claimed in claim 1, wherein the outer casing is made of a plastic material.

4. The built-in electric air pump as claimed in claim 1, wherein the inner casing is made of a plastic material.

5. The built-in electric air pump as claimed in claim 1, wherein the left casing and the right casing have retaining posts extending from inner walls of the left casing and the right casing, a peripheral side of the motor has a heat dissipation hole, and the retaining posts are inserted and secured into the heat dissipation hole.

6. The built-in electric air pump as claimed in claim 1, wherein a top of the inner casing has a rotation control portion, and the rotation control portion is located in the first air opening.

7. The built-in electric air pump as claimed in claim 1, wherein the fourth air opening is located adjacent to a periphery of the impeller.

8. The built-in electric air pump as claimed in claim 1, wherein a DC socket is provided on the inner casing, the DC socket is clamped and fixed between the left casing and the right casing, a DC plug is connected to the DC socket, a first soldering lug of one terminal of the DC socket is welded to a second soldering lug of one terminal of the motor, and a first soldering lug of another terminal of the DC socket is welded to a second soldering lug of another terminal of the motor.

* * * * *